US010694838B2

(12) United States Patent
Zoghbi

(10) Patent No.: US 10,694,838 B2
(45) Date of Patent: Jun. 30, 2020

(54) HANDLE CONNECTOR FOR A ROTATABLE BRUSH HEAD

(71) Applicant: Chebl Zoghbi, Fort Myers, FL (US)

(72) Inventor: Chebl Zoghbi, Fort Myers, FL (US)

( * ) Notice: Subject to any disclaimer, the term of this patent is extended or adjusted under 35 U.S.C. 154(b) by 98 days.

(21) Appl. No.: 15/927,511

(22) Filed: Mar. 21, 2018

(65) Prior Publication Data

US 2018/0279754 A1 Oct. 4, 2018

Related U.S. Application Data

(60) Provisional application No. 62/474,216, filed on Mar. 21, 2017.

(51) Int. Cl.
*A46B 5/00* (2006.01)
*A46B 9/04* (2006.01)

(52) U.S. Cl.
CPC ..... *A46B 5/0083* (2013.01); *A46B 9/04* (2013.01); *A46B 2200/1066* (2013.01)

(58) Field of Classification Search
CPC .. A46B 2200/1066; A46B 5/0083; A46B 9/04
See application file for complete search history.

(56) References Cited

U.S. PATENT DOCUMENTS 2,675,573 A * 4/1954 Strong ..... A46B 7/02 15/176.4
4,731,896 A * 3/1988 de La Tour ..... A46B 5/0075 15/106
5,884,354 A * 3/1999 Anderson ..... A46B 5/0075 15/167.1
5,992,423 A * 11/1999 Tevolini ..... A45D 2/2471 132/120
6,230,357 B1 * 5/2001 Davis ..... A46B 7/04 15/145
8,448,287 B2 * 5/2013 Ponzini ..... A46B 7/042 15/176.1
8,572,796 B2 * 11/2013 Major ..... A46B 5/0095 15/144.1
9,144,297 B2 * 9/2015 Park ..... A46B 7/02
2006/0168746 A1 * 8/2006 Guyuron ..... A47K 7/04 15/97.1
2008/0172812 A1 * 7/2008 Dean ..... A46B 5/0075 15/22.1
2009/0272332 A1 * 11/2009 Lin ..... A01K 13/002 119/633
2010/0307426 A1 * 12/2010 Bertsch ..... A01K 13/002 119/601
2012/0066853 A1 * 3/2012 Schiesz ..... A46B 5/0075 15/145

* cited by examiner

*Primary Examiner* — Marc Carlson
(74) *Attorney, Agent, or Firm* — William E. Noonan

(57) ABSTRACT

A handle connector assembly for a rotatable brush head includes a receptacle formed in the handle and including a chamber with a plurality of sides that face radially inwardly and a compartment communicably interconnected to the chamber. A hub carried by the brush head includes a first locking lip that is received by the compartment. The receptacle has a second locking lip for lockably interengaging the first locking lip. The hub also includes a plurality of detents that are rotated through the chamber receptacle to selectively engage corresponding corners in the chamber and hold the brush head at a selected angular orientation relative to the handle.

20 Claims, 7 Drawing Sheets

HANDLE CONNECTOR FOR A ROTATABLE BRUSH HEAD

RELATED APPLICATION

This application claims the benefit of U.S. Provisional Application Ser. No. 62/474,216 filed Mar. 21, 2017.

FIELD OF THE INVENTION

This invention relates to a rotatable brush head and, more particularly, to an improved assembly for rotatably interconnecting the brush head to a handle of a brush.

BACKGROUND OF THE INVENTION

Rotatable brush heads have long been available. See Saxe, U.S. Pat. No. 1,442,363, which describes a toothbrush having a brush head that may be rotatably adjusted between various selected brush head angles. Such forms of angular adjustment allow the head of the toothbrush to be oriented to more comfortably and effectively clean particular areas of the user's teeth.

Brush heads such as Saxe exhibit problems because of the manner in which the brush head is rotatably interconnected to the handle of the brush. These products utilize inserts mounted to the handle of the brush, which engage corresponding recesses formed in the brush head. This allows the head to be twisted and held at a selected angular orientation relative to the handle. In order to properly effect this operation, the brush must be constructed so that the head is pressed or squeezed against the handle. In Saxe, this is accomplished through the user of a connecting pin. The formation of pins, inserts and recesses increases the manufacturing cost of this type of rotatable brush. Moreover, the required compression between the brush head and brush handle will eventually weaken the interconnection and cause the device to fail. The brush head may separate entirely from the handle and at a minimum, the brush head is apt to loosen sufficiently such that the brush head can no longer be successfully rotated in a stepped manner and held in place in a selected angular orientation relative to the handle. The recesses and inserts also tend to collect debris, which can jam or otherwise interfere with smooth turning of the brush head.

SUMMARY OF THE INVENTION

It is an object of the present invention to provide a handle connector assembly for a rotatable brush head that features an improved mechanical interconnection between the head and handle of the brush.

It is a further object of this invention to provide a handle connector for a rotatable brush head that does not require the brush head and handle to be squeezed together in order to properly operate, and which is therefore more durable, and simpler and less expensive to manufacture than previous devices.

It is a further object of this invention to provide a means for interconnecting a rotatable brush head to a brush handle that eliminates parts that can become clogged and cause jamming or poor operation of the device.

It is a further object of this invention to provide a handle connector for a rotatable brush head that will not loosen or fail as quickly as conventional connectors.

It is a further object of this invention to provide a handle connector for a rotatable brush head that may be employed in toothbrushes and many other types of brushes.

It is a further object of this invention to provide a brush head and handle connector that is more durable, cleaner and reliable than existing brush head connector mechanisms.

It is a further object of this invention to provide a brush head and brush handle connector assembly that may be effectively and reliably adjusted through multiple discrete brush head angles without prematurely loosening or otherwise failing.

This invention features a connector assembly for rotatably attaching a brush head to a handle. One of the brush head and the handle carries a hub that is interengageable with a receptacle formed in the other of the handle and the brush head. The hub includes a shaft and an even number of positioning detents that are attached to and extend radially outwardly from the shaft. The detents can be arranged in opposing pairs about the shaft. The shaft projects upwardly from the brush head and further includes a first gripping component for releasably connecting to a complementary second gripping component formed in the receptacle. The receptacle further includes a substantially polygonal chamber defined by an even number of side surfaces or walls that surround and inwardly face a central axis of the receptacle. The walls have substantially equal respective lengths such that the chamber has a regular polygonal configuration. An even plurality of corners are formed between respective adjoining pairs of the walls of the polygonal chamber. When the hub is inserted into the receptacle, the first and second gripping components releasably interengage and the detents are interengaged with the polygonal chamber of the receptacle. Rotating the brush head relative to the handle causes each opposing pair of detents to interengage corresponding opposing corners of the polygonal chamber of the receptacle to hold the brush head at a selected angular orientation relative to the brush handle.

In a preferred embodiment, the brush head includes bristles that extend from a first side of the brush head and the hub is attached to and extends from an opposite side of the brush head. The receptacle may be formed in the handle. In alternative versions, the placement of the hub and receptacle may be reversed such that the hub carried by the handle and the receptacle is formed in the brush head.

Typically, the polygonal portion of the receptacle includes either octagonal or hexagonal configuration. The hub may include four detents spaced 90° apart about the circumference of the shaft. In this manner, when the brush head is rotated to a selected angular orientation, a pair of diametrically opposed detents interengage opposing corners of the polygonal chamber of the receptacle to hold the brush head in the selected angular position.

The first gripping component attached to the hub may include a circular first locking lip extending about the shaft. The complementary second gripping component formed in the receptacle may include an annular second locking lip formed within the receptacle and adjacent to the polygonal chamber of the receptacle. The hub may include a truncated conical tip attached to a distal end of the shaft. The receptacle may include a complementary truncated conical portion communicably connected to the polygonal chamber for receiving the truncated conical tip of the hub. A lower edge of the truncated conical portion may form the lip of the first gripping component. The conical shape allows the hub to be slidably inserted through the center of the second locking lip in the receptacle such that the first locking lip engages the second locking lip to secure the brush head to the handle.

In alternative embodiments, a detent accommodating pocket may be formed in the corner between each adjoining pair of walls of the polygonal portion. An even number of pockets is thereby formed in the receptacle. Each pocket has a concave shape for generally conformably and releasably receiving a respective detent. When the hub is inserted into the receptacle in versions of this type, the first and second gripping components are again releasably interengaged and the detents are interengaged with the side walls and pockets of the receptacle. Rotating the brush head relative to the handle causes each opposing pair of detents to interengage opposing pockets of the polygonal chamber of the receptacle. This again holds the brush head at a selected angular orientation relative to the brush head.

In the pocketed version of this invention, the detents and pockets may include angled side walls. Alternatively, the detents and pockets may include a curved or arcuate shape. In either case, the shape should be such that the brush head may be readily manipulated and rotated through selected angular positions relative to the handle. By the same time, the detents and accommodating pockets should be configured so that the brush head is held securely in a selected angular position during use of the brush. The composition of the hub and the receptacle may be selected to complement the curvature or angles of the detents and receptacles so that either smooth and convenient rotation of the head or secure retention of the head in a selected angular position are provided as needed.

BRIEF DESCRIPTION OF THE DRAWINGS

Other objects, features and advantages will occur from the following description of a preferred embodiment and the accompanying drawings, in which.

DETAILED DESCRIPTION OF PREFERRED EMBODIMENTS

Figure 1:
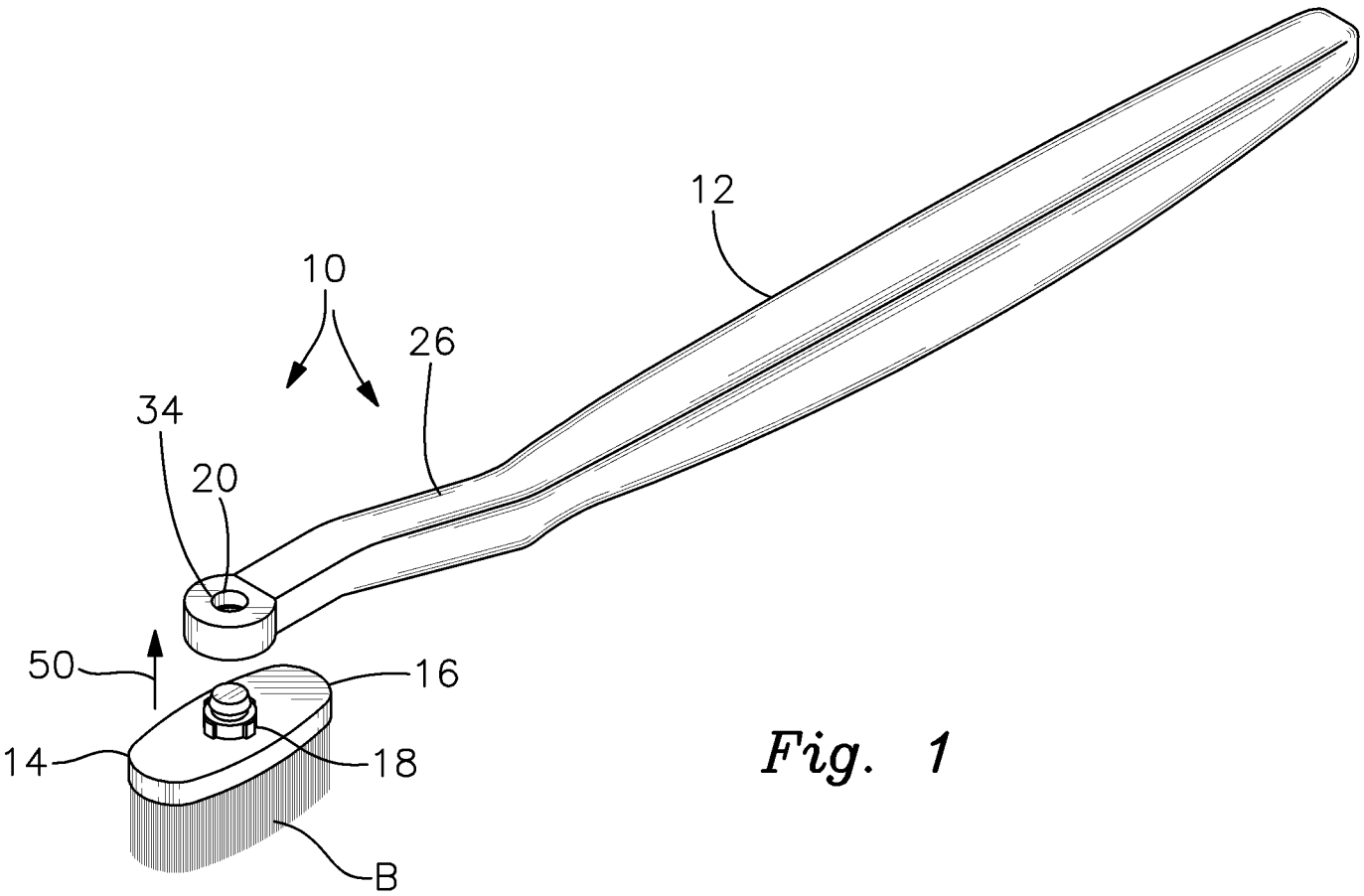
FIG. 1 is a top perspective view of a toothbrush with a rotatable brush head that employs the connector assembly of this invention; the hub is depicted as attached to one side of the rotatable brush head.
Figure 2:
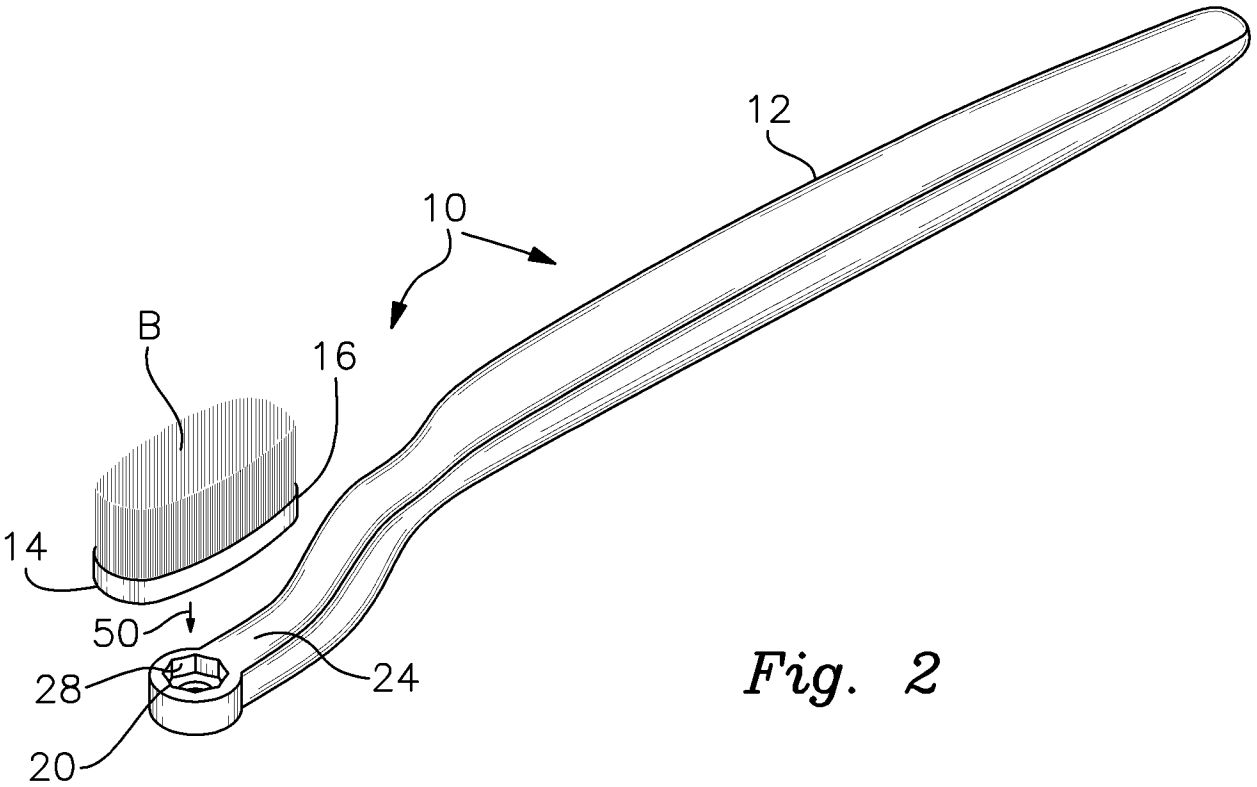
FIG. 2 is a bottom perspective view of a handle and brush head featuring the connector assembly and particularly depicting the receptacle as formed in the handle.

There is shown in FIGS. 1 and 2 a rotatable toothbrush 10 including an elongate handle 12 and a brush head 14 that is rotatably attachable to a distal end of handle 12. Head 14 includes a base 16. A plurality of conventional bristles B are secured to and extend from a bottom side of base 16. The opposite upper side of base 16 carries a hub 18, which is lockably insertable into a receptacle 20 formed in a distal portion of handle 12. This interconnection operatively and rotatably interconnects the head 14 to handle 12 in accordance with this invention and is described in detail below.

Handle 12 and brush head 14 are constructed in a manner that will be obvious to persons skilled in the art of toothbrush manufacture and/or other brush constructions. In particular, various shapes, dimensions and materials may be employed, all of which are conventional. It should be particularly noted that the shape and size of brush head 14 are not limited to those shown in the drawings and may be varied within the scope of this invention. Likewise, the length and configuration of handle 12 may be altered as will be understood by persons skilled in the art.

It should also be understood that the connector assembly disclosed herein, which comprises hub 18 and receptacle 20, may be employed to effectively mount various other types of brush heads, (i.e. hairbrushes, cleaning brushes, pet grooming brushes, etc.) to respective brush handles. The connector assembly may be used reliably and effectively in virtually any application where the use of an angularly adjustable brush head is desired.

Figure 3:
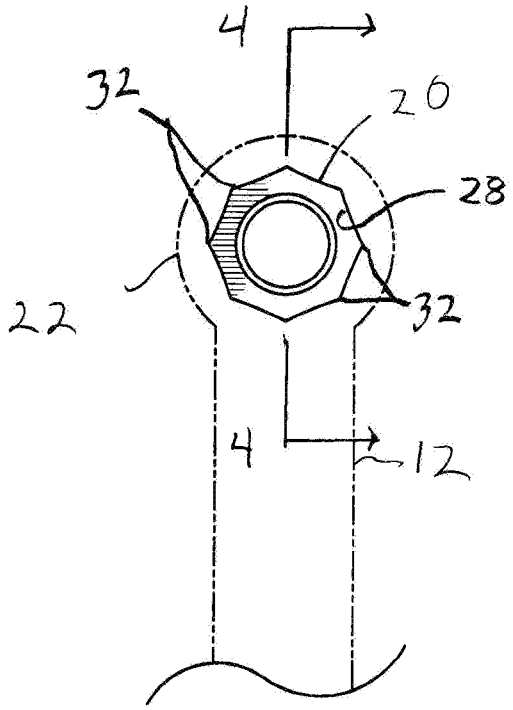
FIG. 3 is a bottom plan view of the receptacle formed proximate one end of the brush handle.
Figure 4:
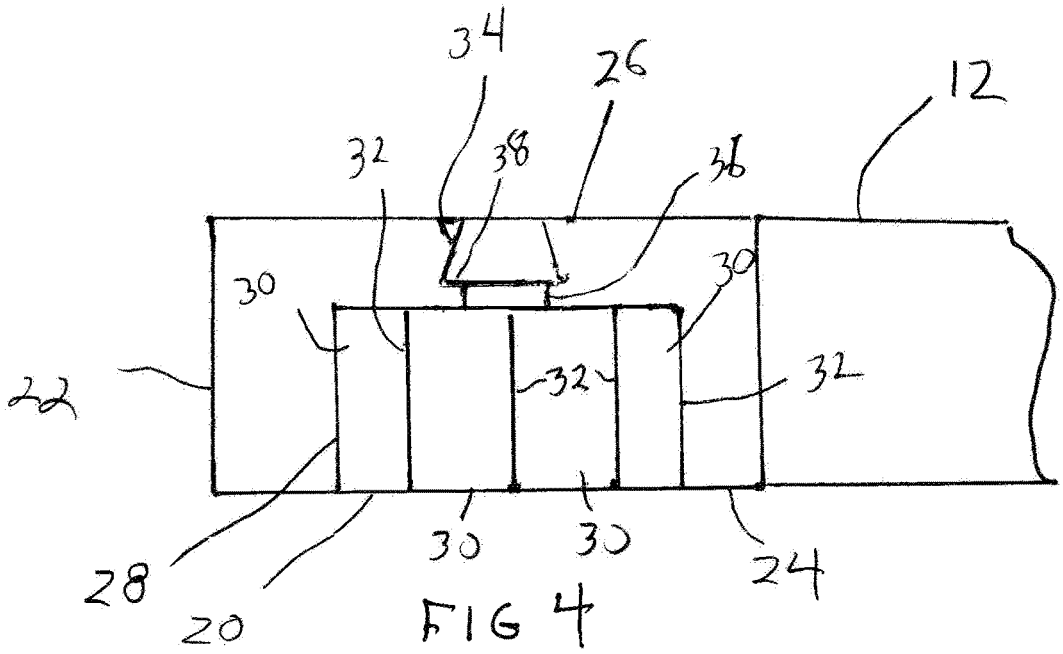
FIG. 4 is a side, cross sectional view of the brush handle with the receptacle formed therein proximate one end of the handle.

As further shown in FIGS. 2-4, receptacle 20 is formed in a distal ring section 22 of handle 12. The receptacle extends fully through the handle from the bottom surface 24 of handle 12 to the top surface 26 of the handle. More particularly, receptacle 20 includes a lower portion comprising a chamber 28 that has an octagonal cross sectional configuration, as best depicted in FIG. 3. In alternative embodiments, the lower chamber may have other polygonal (e.g. hexagonal) cross sectional shapes. It is especially preferred that the cross sectional shape of the lower chamber be a regular polygon. Each side of the polygon defining the chamber is defined by an interior wall 30, four of which are shown in the cross sectional view of FIG. 4. The lower chamber thereby includes a plurality of corners 32 formed between respective pairs of adjoining walls 30. Each corner is formed at a respective vertex of the polygonal chamber, wherein an adjoining pair of interior wall 30 intersect. These corners effectively form position-locating notches that define the various angular orientations or positions at which the rotating brush head may be set and held. In some versions the interior walls of polygonal chamber 28 may have a slightly convexly curved shape. Rotation of the brush head between selected positions is described more fully below.

Receptacle 28 further includes an upper compartment 34 that is best shown in FIGS. 1 and 4. Compartment 34 includes a truncated conical shape, which is best depicted in FIG. 4. The upper, reduced diameter end of compartment 34 is formed in top surface 26 of handle 12. The lower end of compartment 34 is recessed within the brush handle. An intermediate, generally cylindrically shaped channel 36 communicably interconnects the upper end of chamber 28 with the lower end of compartment 34. As a result, receptacle 20, which comprises communicably connected chamber 28, channel 36 and compartment 34, extends completely through handle 12 from the bottom to the top surfaces of the handle. Intermediate channel 36 is positioned through ring 22 of handle 12 such that the channel interconnects an axial center of lower chamber 28 with an axial center of compartment 34. The lower end of compartment 34 thereby forms a locking lip 38 that annularly surrounds channel 36.

Figure 5:
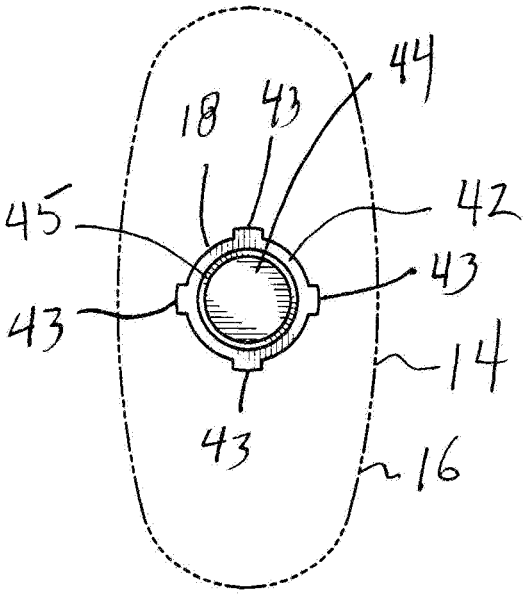
FIG. 5 is a top plan view of the hub attached to the brush head.
Figure 6:
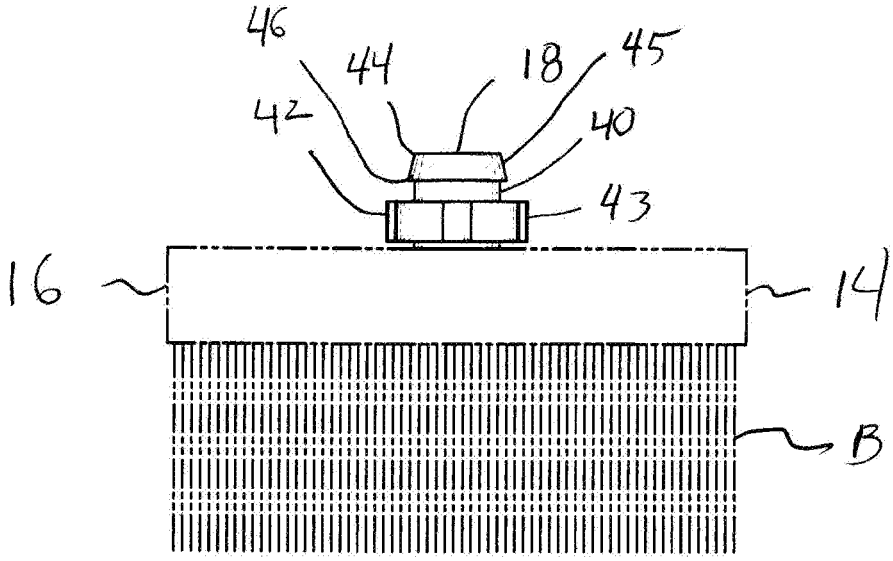
FIG. 6 is a side elevational view of the brush head with the hub attached thereto.

As illustrated in FIGS. 2, 5, and 6, hub 18 includes a cylindrical shaft 40 that is fastened to and projects upwardly from the top surface of brush head base 16. In preferred embodiments, shaft 40 comprises a plastic that is molded unitarily with base 16 of brush head 14. In other embodiments, the shaft and hub may be formed separately from the brush head and attached thereto employing known manufacturing techniques. An annular component 42, FIGS. 4 and 5, surrounds and is permanently attached to shaft 40 proximate base 14. A tip 44 having a truncated conical shape is attached to an upper end of shaft 40. Annular component 42 includes four or some other, preferably even, number of detents 43 that extend radially outwardly from annular component 42. The radial detents should be formed in opposing pairs about the circumference of annular member 42. It is particularly preferred that four detents be formed 90° apart about the hub.

A tip 44 having a truncated conical shape is attached to an upper end of shaft 40. The lower, wide diameter end of tip component 44 includes a somewhat greater diameter than that of shaft 40. Tip component 44 thereby forms a locking lip 46 that generally encircles shaft 40. As will be described more fully below, when the brush head and handle are assembled, lip 46 of hub 18 lockably interengages complementary locking lip 38 of compartment 34 to secure the brush head to the handle.

In preferred embodiments, the individual components of hub 18, i.e. shaft 40, annular component 42, detents 43, and tip 44 are molded or otherwise unitarily formed. In fact, the individual components of hub 18 may be molded unitarily with base 16 of brush head 14 and comprise the same plastic material used to manufacture the base of the brush head.

Toothbrush 10 is assembled by attaching brush head 14 to handle 12. In particular, hub 18 of brush head 14 is inserted and pressed into receptacle 20 of handle 12, as indicated by arrows 50 in FIGS. 1 and 2. Locking tip 44 of hub 18 is pushed through intermediate channel 36 of handle receptacle 20. The resilient plastic material comprising hub 18 and handle 12 is sufficiently pliable and elastic to permit the truncated, conical tip 44 to slide through channel 36 and into compartment 34 of receptacle 20. The exterior side wall 45 of tip 44 and the interior side wall of compartment 34 have corresponding truncated conical shapes and sizes that permit the locking tip 44 of hub 18 to effectively mate or nest within the upper compartment 34 of receptacle 20. Locking lip 46 of tip 44 interengages the annular locking lip 38 formed at the lower end of compartment 34. This effectively locks the brush head onto the handle, while permitting rotation or turning of the brush head relative to the handle as described below.

Figure 7:
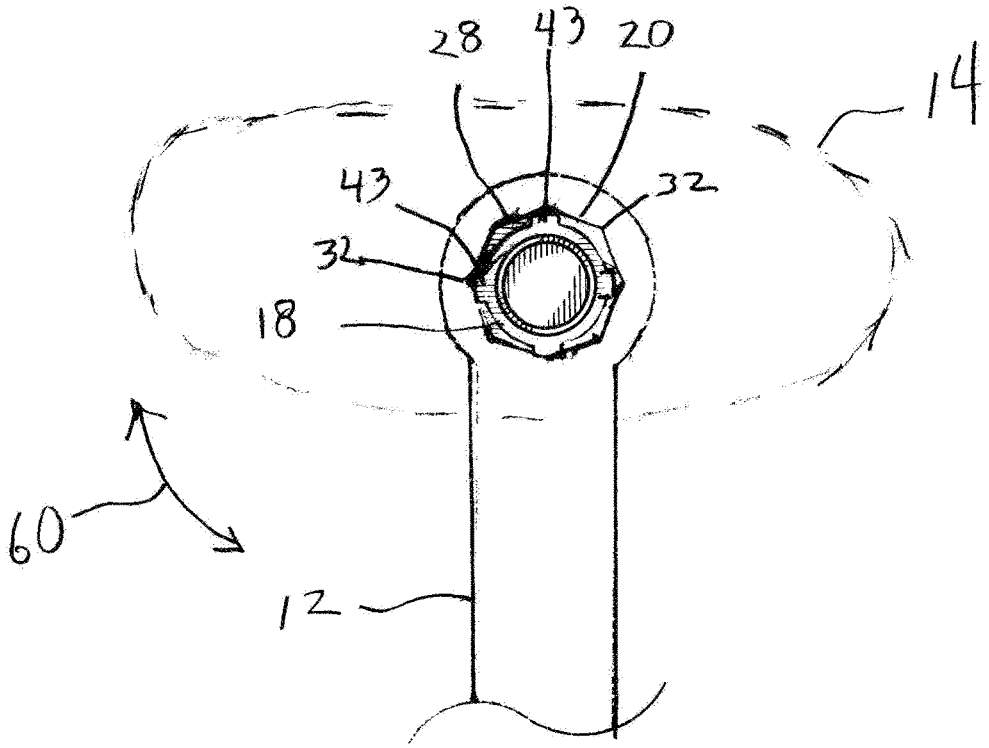
FIG. 7 is a bottom plan view of the hub as operatively positioned within the receptacle and with the remainder of the brush head depicted in phantom.
Figures 8, 9, 10:
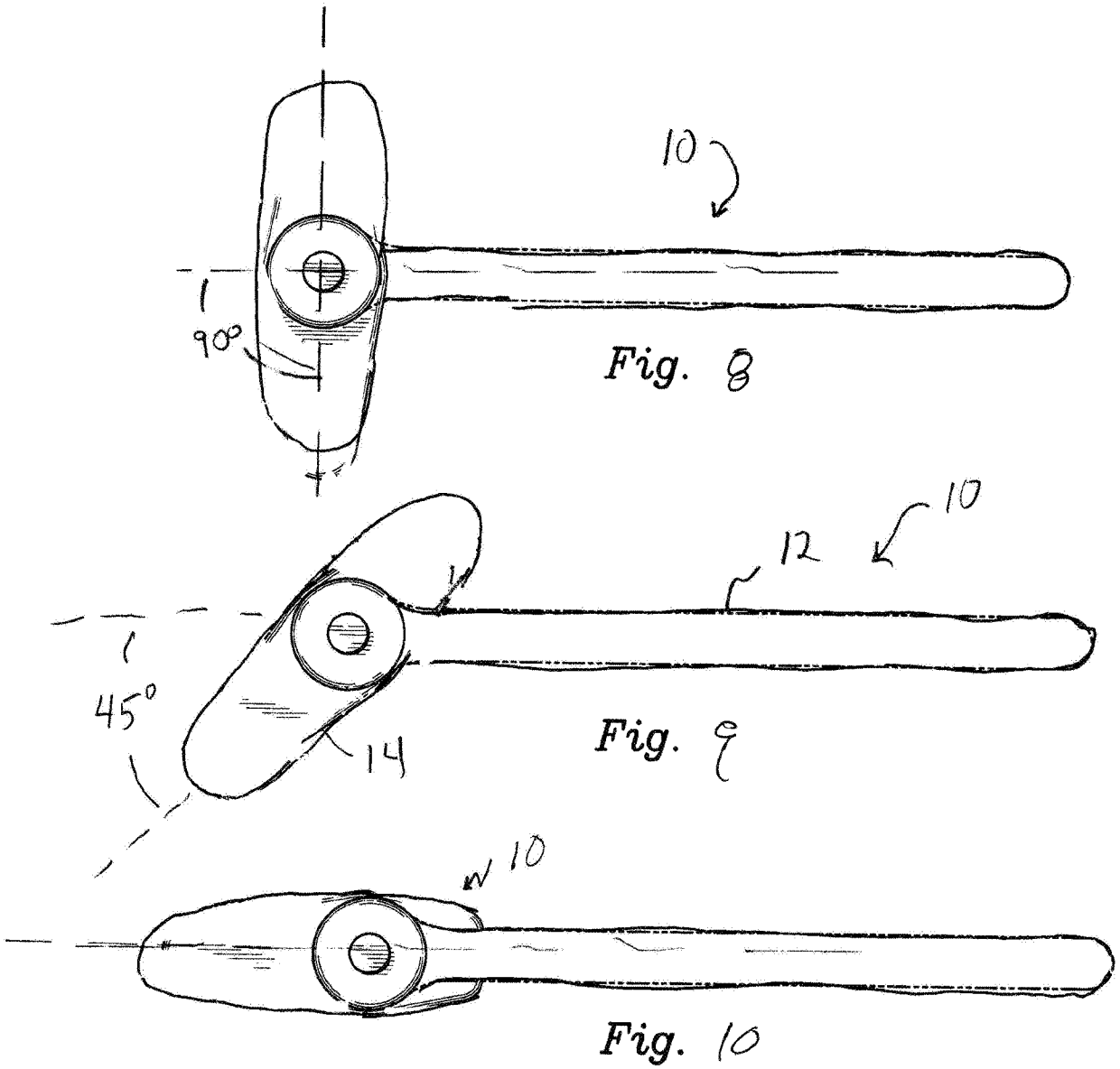
FIGS. 8-10 are top plan views of the rotating toothbrush with the brush head positioned at respective angular orientations relative to the handle of the brush.

When hub 18 is inserted in receptacle 20 as described above, shaft 40 of hub 18 extends through intermediate channel 36 of receptacle 20. The annular component 42 bearing radial detents 43 is thereby positioned within lower octagonal chamber 28 of receptacle 20. The corresponding components of hub 18 (i.e. annular component 42 and detents 43) and receptacle 28 (i.e. octagonally arranged side walls 30 and corners/notches 32) are sized and shaped to permit the hub to be selectively rotated in a stepped manner between eight different angular orientations or positions within receptacle 28. In particular, as indicated by double headed arrow 60 in FIG. 7, brush head 14 may be turned manually relative to handle 12. This causes hub 18 to rotate within receptacle 28. As previously described, the interengaging locking lips 38 and 46 of compartment 34 and locking tip 44 respectively retain the hub and brush head in attachment with the receptacle 18 and handle 12. At the same time, the hub and brush head may be rotated in either direction indicated by arrow 60 relative to the handle. The radial detents 43 slide across the opposing walls 30 of octagonal chamber 28 until the opposing pairs of detents 43 interengage complementary opposing pairs of corners 32 in chamber 28. This holds the brush head at a corresponding selected angular orientation relative to the brush handle. For example, as shown in FIG. 7, brush head 14 is oriented with its axis generally perpendicular or at 90° to the longitudinal axis of handle 12. The brush head is held in this position until a small or fairly modest amount of manual pressure or force is applied to release the locking interengagement between the detents and the corners and turn the brush head in either a clockwise or counterclockwise direction. If the brush head is turned clockwise, the detents will be rotated within the receptacle until they engage the next opposing pair of corners or notches 32. This will hold the brush head 14 at an orientation wherein the axis of the brush head is displaced 45° from axis of the brush handle as depicted in FIG. 9. Once again, the brush head is held at this orientation by the interengaging detents of hub 18 and corners of receptacle 28. Brush head 14 may be further rotated, as shown in FIG. 10, by exerting sufficient manual force to the brush head such that it rotates into the position shown in FIG. 10. Once again, the opposing detents are first disengaged from the opposing receptacle corners previously holding them in the position shown in FIG. 9, and the brush head is rotated into a position where it is axially aligned with the handle. See FIG. 10. Therein, the hub detents 43 are engaged with and held in place by the next successive pair of opposing corners or notches 32. As a result, brush head 14 is held in the position shown in FIG. 10 for use in accessing and cleaning teeth in a manner best achieved with the depicted angular orientation. Stepped rotation of the brush head may be performed in an analogous manner to selectively achieve each of eight different angular brush head orientations.

It should be understood that alternative operations within the scope of this invention may be performed by providing the hub with other, even numbers of detents (e.g. 2, 6, 8) and likewise providing the handle receptacle with different cross sectional polygonal configurations (e.g. hexagonal for instance). It should also be understood that a similar connector construction may be employed in various other types of brushes in accordance with this invention.

The brush connector construction of this invention provides for significant advantages over the prior art. Significantly, the brush head and handle feature a pressure or compression-free interconnection that resists premature loosening and detachment over time. The brush head and handle do not have to be squeezed or compressed together in order to push the detents or other insert elements into corresponding holes or receptacles in the handle. Rather, the present invention features pressure-free locking interengagement and complementary stepped operating components that face one another radially relative to the axis of rotation rather than the vertically as in the prior art. Such complementary stepped operating components (i.e. the radial detents and inwardly facing polygonal walls and corners) do not have to be pressed or squeezed together while turning in order to successfully interengage, as is required in vertically oriented brush coupling systems. The present construction is thus much more resistant to loosening over time and to potential detachment and failure. An improved, longer-lasting and more durable product is thereby achieved. By the same token, an extremely secure product with a reliable stepped operation between successive angular positions is provided. The present invention also eliminates the use of multiple insert holes and corresponding inserts, which can become clogged by debris during use and render the product inoperable. Applicant's brush assembly also features a simpler unitary construction for both the brush head and the handle receptacle, which greatly reduces manufacturing and assembly costs. The present invention eliminate extraneous pieces and part which can be subject to failure.

It should also be noted that the hub structure disclosed herein alternatively may be formed in the handle and the complementary receptacle, as described, may be formed in the brush head, Such a construction will exhibit a similar operation and provide similar advantages to those described above.

Figure 11:
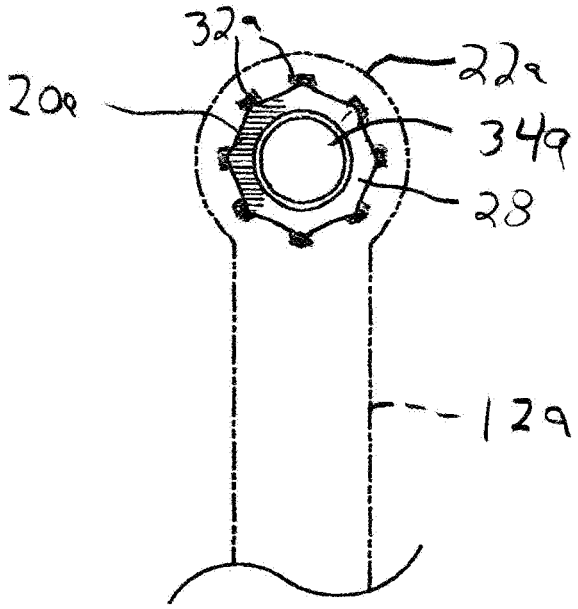
FIG. 11 is a bottom plan view of a version of the brush handle wherein the receptacle includes an even plurality of pockets and each pocket interconnects an adjoining pair of side walls of the receptacle.

In alternative embodiments, the corners of the polygonal receptacle may include pockets, notches, recesses or grooves, which may be rounded or tapered, for facilitating interengagement between opposing pairs of detents and corresponding opposing corners in the lower chamber. An example of such an embodiment is depicted, for example, in FIG. 11 wherein a handle 12*a* includes a receptacle 20*a* formed in a distal ring portion 22*a* of the handle. As in the previously described embodiment, receptacle 20*a* includes an upper compartment 34*a* and a lower polygonal chamber 28*a* having eight side walls of substantially equal length. In this version, a locking notch or pocket 32*a* is formed at each corner of chamber 20*a*. Each of the pockets 32*a* is configured to have a shape that generally conforms to the shape of one of the opposing detents carried by the hub of the brush head.

Figure 12:
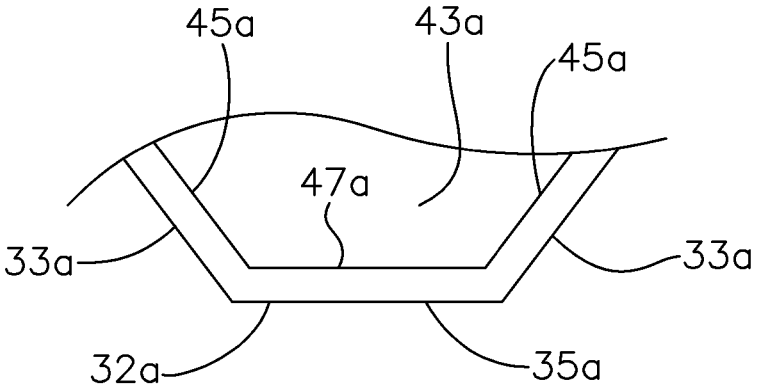
FIG. 12 is a cutaway view depicting the interengagement between a corresponding detent and pocket of the connector wherein the detent and the pocket include generally conforming angled side walls.
Figure 13:
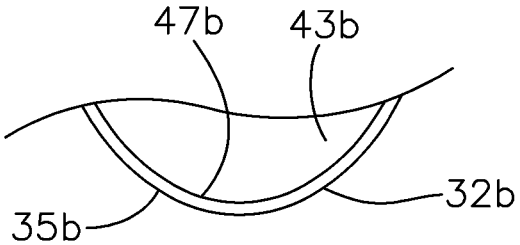
FIG. 13 is a cutaway view of a representative detent and pocket having complementary and generally conforming curved surfaces.

FIGS. 12 and 13 depict exemplary corresponding shapes of representative pockets and interengaged detents that may be exhibited in different versions of the connector. For example, in FIG. 12, each detent has a pair of angled side walls 45*a*, as well as a flat distal wall 47*a*, which interconnects angled side walls 45*a*. Likewise, each pocket 32*a* features a pair of angled side walls 33*a*, which are interconnected by a flat bottom wall 35*a*. As a result, each detent 43*a* and interengaged pocket 32*a* have generally conforming shapes such that when a pair of opposing detents interengage an opposing pair of pockets featuring this configuration, the brush head is held securely in place in the selected angular position. The brush head may then be conveniently rotated into an alternative position by simply turning the brush head with reasonable but not excessive finger pressure such that the previously engaged detents and corresponding accommodating pockets slidably disengage one another. This allows the brush head to easily rotate within the polygonal chamber until a newly selected brush head position is obtained, and wherein the opposing detents are reengaged with another opposing pair of pockets.

In FIG. 13 representative pocket 32*b* has a curved or arcuate concave shape, which allows the pocket to selectively receive and interengage a detent 43*b* having a curved surface 47*a* which generally conforms to the curved surface 35*b* of pocket 32*b*. The complementary curved and conforming shapes of pockets 32*b* and detents 43*b* again allow the detents to be rotated conveniently and reliably within the receptacle chamber relative to the pockets. As a result, the brush head is readily rotatable relative to the brush handle. The curved detents are also firmly interengaged with selected opposing pairs of conformably curved pockets to hold the brush head securely in place at a selected rotational position relative to the handle.

It should be understood that the respective conforming configurations of the pockets and detents may be varied within the scope of this invention. The shapes are determined in order to provide the rotatable brush head with a smooth and reliable rotating operation. At the same time, the corresponding configurations of the detents and the pockets are formed so that when the brush is being used, the head is held securely in place at a selected angular position through the secure interengagement of the corresponding, conformably shaped detents and pockets.

The angle of the side walls depicted in the version of FIG. 12 and the curvature of the corresponding surfaces shown in FIG. 13 may be varied to provide either a smoother and easier rotation or a tighter and more secure interengagement between the brush head and the handle at a selected angular position. In particular, in the angled wall version shown in FIG. 12, an obtuse angle is preferably provided between the side walls 45*a* and 33*a* and the respective flat interconnecting walls 47*a* and 35*a*. If 90° angles or acute angles were employed by the detents and pockets, the brush head would typically be difficult, if not impossible to rotate. By the same token, the angle between walls 45*a*, 33*a* and surfaces 47*a*, 35*a*, respectively, should not be made too wide or flat; otherwise, the brush head will not be held securely enough in the selected position.

The curvature of the interengaged detents 43*b* and pockets 32*b* in FIG. 13 may likewise be adjusted to provide for a desired blend of rotatability and retention strength. Conforming surfaces 47*b* and 35*b* having a greater curvature are typically able to achieve better holding power. Conforming curves which are more shallow are typically easier to rotate.

It should also be understood that the rotatability and holding capability of the apparatus may be varied by employing plastics having various degrees of strength and rigidity. The materials (e.g. Delryn™ or other types of plastic) forming the brush head and handle may also be selected to provide for a desired balance of rotatability and holding or retention strength. The use of softer plastics makes the brush head easier to rotate, whereas more rigid or stronger plastics enable the interengaged detents and pockets to hold the brush head more snugly and securely in place at the selected angular position. When stronger or more rigid plastics are employed, the detents and interengaged pockets may feature wider angles between the side surfaces and the interconnecting flat surfaces, whereas the use of softer plastics permit smaller detent surface angles to be employed. By the same token, stronger plastics allow the use of detents and pockets having gentler curvature whereas softer plastics allow the use of a larger conforming curvature between the detents and the pockets. In all cases, the type of plastic and the angles or curvature used for the detents and pockets should be selected to provide a satisfactory blend of both easy and reliable rotation and secure holding of the brush head at a selected angular orientation.

From the foregoing it may be seen that the apparatus of this invention provides for a connector assembly for securing a brush head or a toothbrush or other type of brush to a handle of the brush. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

What is claimed is:

1. A connector assembly for rotatably attaching a brush head to a handle, said assembly comprising:

a hub carried by one of the brush head and the handle, said hub being interengageable with a receptacle formed in the other of the handle and the brush head;

said receptacle including a chamber that has a substantially regular polygonal cross sectional configuration defined by an even number of substantially flat and discrete adjoining interior peripheral walls that symmetrically surround and inwardly face a central axis of said receptacle;

an even plurality of corners, each formed between a respective pair of said adjoining interior peripheral walls of said polygonal chamber such that said corners are arranged in opposing pairs symmetrically about said polygonal chamber;

said hub including a shaft inserted into said receptacle and a plurality of positioning detents attached to and extending radially outwardly from said shaft within said polygonal chamber, said detents being interengagable with and slidable across said substantially flat walls of said chamber and arranged angularly about said shaft to be substantially simultaneously interengagable with respective said corners of said polygonal chamber;

said shaft further including a first locking component connected to a complementary second locking component formed in said receptacle to interlock said hub with said receptacle while permitting said hub to rotate in said receptacle;

whereby said brush head is rotated relative to said handle while said hub remains interlocked with said receptacle to rotate said hub through said receptacle and drive said positioning detents slidably across said substantially flat walls of said polygonal chamber and substantially simultaneously into interengagement with two or more selected said corners of said polygonal chamber to hold the brush head at a selected angular orientation relative to the brush handle.

2. The assembly of claim 1 in which polygonal chamber has an octagonal shape.

3. The assembly of claim 1 in which said hub includes four detents spaced 90° apart about the circumference of said shaft.

4. The assembly of claim 1 in which said first locking component includes a circular first locking lip extending about said shaft of said hub and said second locking component includes an annular second locking lip formed within said receptacle and adjacent to said polygonal chamber of said receptacle.

5. The assembly of claim 4 in which said hub includes a truncated con ical tip attached to a distal end of said shaft.

6. The assembly of claim 5 in which said receptacle includes a complementary truncated conical portion communicably connected to said polygonal chamber for receiving said truncated conical tip of said hub.

7. The assembly of claim 6 in which a lower edge of said truncated conical portion forms said first locking lip of said first locking component.

8. The, assembly of claim 1 in which each said corner includes a detent-accommodating pocket between said adjoining pair of substantially flat interior peripheral walls, each said pocket having a concave shape for generally conformably and releasably receiving a respective convexly shaped detent and wherein each said pocket is narrower than each said interengaged peripheral wall.

9. The assembly of claim 8 in which said detents and said pockets include conforming tapered shapes.

10. The assembly of claim 8 in which said detents and pockets include conforming curved shapes.

11. The assembly of claim 1 in which each said interior peripheral wall is contiguous with a first said adjoining wall at a first said corner and contiguous with a second said adjoining wall at a second said corner.

12. The assembly of claim 11 in which each said corner is defined by a respective polygonal vertex between adjoining said walls of said chamber.

13. The assembly of claim 1 in which said sub.stantially flat adjoining interior peripheral alls define a closed regular polygon.

14. The assembly of claim 1 in which each said wall includes a flat surface extending fully between an adjacent pair of said corners that respectively interconnect said wall to respective adjoining walls.

15. The assembly of claim 1 in which each said wall is wider than each said detent and each said corner.

16. The assembly claim 1 in which said hub and said receptacle are composed of a resilient plastic to facilitate sliding of said detents across said substantially flat walls of said polygonal chamber.

17. A rotatable brush head assembly comprising:

a brush head having a plurality of bristles attached to and extending from one side thereof;

a handle rotatably interengaged with said brush head;

a hub carried by one of said brush head and the handle, said hub being interengageable with a receptacle formed in the other of said handle and said brush head;

said receptacle including a chamber that has a substantially regular polygonal cross sectional coniguration defined by an even number of substantially flat and discrete adjoining interior peripheral walls that symmetrically surround and inwardly face a central axis of said receptacle;

an even plurality of corners, each formed between respective pairs of said adjoining interior peripheral walls of said polygonal chamber such that said corners are arranged in one or more opposing pairs symmetrically about said polygonal chamber;

said hub including a shaft received by said receptacle and a plurality positioning detents attached to and extending radially outwardly from said shaft within said polygonal chamber, said detents being interengagable with and slidable across said substantially flat walls of said chamber and arranged angularly about said shaft to be substantially simultaneously interengagable with respective said corners of said polygonal chamber;

said shaft further including a first locking component connected to a complementary second locking component formed in said receptacle to interlock said hub with said receptacle while permitting said hub to rotate in said receptacle;

whereby said brush head is rotated relative to said handle while said hub remains interlocked with said receptacle to rotate said hub through said receptacle and drive said positioning detents slidably across substantially flat walls of polygonal chamber into interengagement with two or more selected said corners of said polygonal chamber to hold said brush head at a selected angular orientation relative to said brush handle.

18. A rotatable toothbrush assembly comprising:

a resilient plastic toothbrush head having a plurality of bristles attached to and extending from one side thereof;

a resilient plastic toothbrush handle rotatably interengaged with said brush head;

a resilient plastic hub carried by and unitarily joined to one of said brush head and the handle, said hub being interengaged with a receptacle formed in the other of said handle and said brush head;

said receptacle including a chamber that has a substantially regular polygonal cross sectional configuration defined by an even number of substantially flat and discrete adjoining interior peripheral walls that symmetrically surround and inwardly face a central axis of said receptacle;

an even plurality of corners, each formed between respective pairs of said adjoining walls of said polygonal chamber such that said corners are arranged in one or more opposing pairs symmetrically about said polygonal chamber;

said hub including a shaft received by said receptacle and an even number of positioning detents attached to and extending radially outwardly from said shaft within said polygonal chamber, said detents being interengagable with and slidable across said walls of said substantially flat chamber and arranged evenly spaced about said shaft to be substantially simultaneously interengagable with respective said corners of said polygonal chamber;

said shaft further including a first locking component connected to a complementary second locking component formed in said receptacle to interlock said hub with said receptacle while permitting said hub to rotate in said receptacle;

whereby said brush head is rotated relative to said handle while said hub remains interlocked with said receptacle to rotate said hub through said receptacle and drive said positioning detents slidably across said substantially flat interior peripheral walls of said chamber and into interengagement with selected said corners of said polygonal chamber to hold said brush head at a selected angular orientation relative to said brush handle.

19. The assembly of claim 18 in which said first locking component includes a circu lar first locking lip extending about said shaft of said hub and said second locking component includes an annular second locking lip formed within said receptacle and adjacent to said polygonal chamber of said receptacle, said hub including a truncated conical tip attached to a distal end of said shaft, said receptacle including a plementary truncated conical portion communicably connected to said polygonal chamber for receiving said truncated conical tip of said hub, a lower edge of said truncated conical portion forming sa id first locking lip of said first locking component.

20. The assembly of claim 18 in which each said interior peripheral wall is contiguous with a first said adjoining wall at a first said corner and contiguous with a second said adjoining wall at a second said corner, said substantially flat adjoining interior peripheral walls defining a closed regular polygon, each said corner being defined by a respective polygonal vertex between adjoining said walls of said chamber, each said wail including a flat surface extending fully between an adjacent pair of said corners that respectively interconnect said wall to respective adjoining walls each said wall being wider than each said detent and each aid corner.

* * * * *